United States Patent [19]

Iida et al.

[11] 4,048,540

[45] Sept. 13, 1977

[54] ELECTRONIC FLASH UNIT SERVING BOTH AS TRANSMITTER OF A REMOTE CONTROL AND FLASH UNIT FOR FLASH PHOTOGRAPHY

[75] Inventors: Yozo Iida, Komae; Yasuhito Kawahara; Shigemi Igarashi, both of Tokyo, all of Japan

[73] Assignees: Nippon Kogaku K.K.; Sato Koki K.K., both of Tokyo, Japan

[21] Appl. No.: 650,692

[22] Filed: Jan. 20, 1976

[30] Foreign Application Priority Data

Jan. 27, 1975 Japan ..... 50-12165[U]

[51] Int. Cl.[2] ..... H05B 41/32

[52] U.S. Cl. ..... 315/241 P; 354/129; 354/140; 354/141

[58] Field of Search ..... 315/241 P; 250/214 S; 354/126, 129, 131, 132, 140, 141, 145

[56] References Cited

U.S. PATENT DOCUMENTS 3,335,650 8/1967 Schmidt et al. ..... 354/126

FOREIGN PATENT DOCUMENTS 1,110,512 2/1956 France ..... 315/241 P

*Primary Examiner*—Eugene R. La Roche

*Attorney, Agent, or Firm*—Fitzpatrick, Cella, Harper & Scinto

[57] ABSTRACT

In an electronic flash unit serving both as the transmitter of a remote control device and a flash unit for flash photography, there is provided a power source, a flash discharge tube, and a discharging circuit having an interlocking switch adapted to be closed in response to electrical connection of the flash unit to the synchro contacts of a camera. The discharging circuit may produce a greater magnitude of discharging current for the flashing of the discharge tube during the closing of the switch than during the opening of the switch. The flash unit further includes a trigger circuit having an extraneously operable trigger switch and effective to trigger the flash discharge tube to effect the discharge of the discharging circuit. Thus, the quantity of flash light emitted from the flash discharge tube is less during the disconnection of the flash unit to the camera's synchro contacts than during the connection of the flash unit to said synchro contacts.

5 Claims, 6 Drawing Figures

ELECTRONIC FLASH UNIT SERVING BOTH AS TRANSMITTER OF A REMOTE CONTROL AND FLASH UNIT FOR FLASH PHOTOGRAPHY

BACKGROUND OF THE INVENTION

1. Field of the Invention

This invention relates to an electronic flash unit serving both as the transmitter of a remote control device and a flash unit for flash photography.

2. Summary of the Invention

The present invention, has, for its object, to provide an electronic flash unit which can decrease the quantity of flash light when used as the transmitter of a remote control device and can increase the quantity of flash light when used as the flash unit for photography and which permits the change-over between the two modes of use to be accomplished by the connection or the disconnection of the flash unit to the synchro contacts of a camera.

According to the present invention, the electronic flash unit comprises a power source, a flash discharge tube, a discharging circuit having an interlocking switch adapted to be closed in response to electrical connection of the flash unit to the synchro contacts of a camera body, the discharging circuit producing a greater magnitude of discharging current for the flashing of the flash discharge tube during closing of the switch than during the opening of the switch, and a trigger circuit having an extraneously operable trigger switch and effective to trigger the flash discharge tube to effect the discharge of the discharging circuit, whereby the quantity of flash light emitted from the flash discharge tube when the connection of the flash unit to the synchro contacts of the camera body is broken is less than that when the connection is established.

The above object and other features of the present invention will become more fully apparent from the following detailed description of some embodiments thereof taken in conjunction with the accompanying drawings.

DESCRIPTION OF THE PREFERRED EMBODIMENTS

Figure 1:
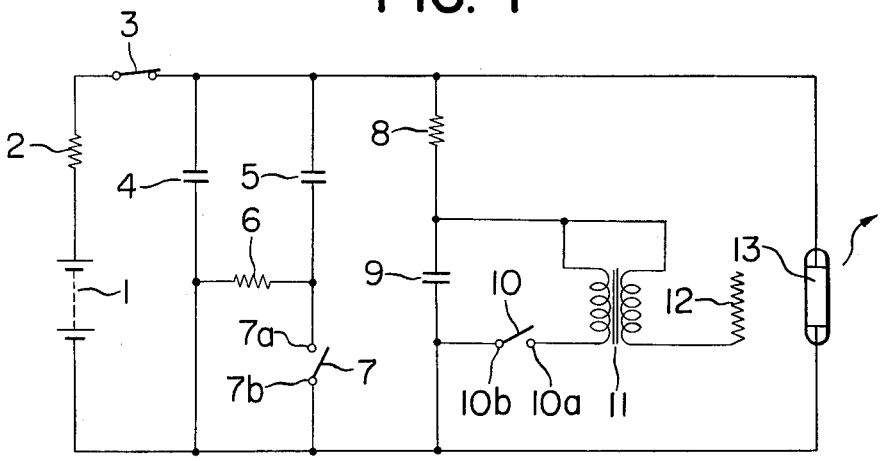
FIG. 1 is a circuit diagram of an embodiment of the present invention.

Referring to FIG. 1 which shows a circuit diagram of the electronic flash unit according to a first embodiment of the present invention, a power source 1 charges a first main capacitor 4 through a protective resistor 2 and a main switch 3 and also charges a second main capacitor 5 further through a resistor 6.

In order that this electronic flash unit may be used for photography, a switch 7 adapted to be closed when the flash unit is connected to the synchro contacts of a camera is parallel-connected to a resistor 6. A resistor 8, a trigger capacitor 9, a trigger switch 10, a transformer 11 and a trigger electrode 12 together constitute the trigger circuit for a flash discharge tube 13.

When the flash unit is used as the transmitter of a remote control device, the switch 7 is opened so that closing of the main switch 3 charges the capacitors 4, 5 and 9. When the trigger switch 10 is closed, current is discharged from the capacitor 9 to cause the trigger electrode 12 to generate a high tension pulse which excites the discharge tube 13. This causes the first main capacitor 4 to discharge to the discharge tube 13, which thus emits a flash light acting as a transmission signal. When this occurs, the second main capacitor is prevented from discharging by the presence of the resistor 6. The flash light transmission signal is received by the receiver of the remote control device to control a cinecamera or a motor drive camera, for example.

When, on the other hand, the flash unit is used as the flash unit for flash photography, the synchro contacts of the camera are connected to the trigger switch 10 of the flash unit to thereby close the switch 7 as will later be described, so that closing of the camera's synchro switch causes the electrode 12 to generate a high tension pulse which excites the discharge tube 13, as already described. Thus, both of the first main capacitor 4 and the second main capacitor 5, this latter being affected by closing of the switch 7, discharge to the discharge tube 13, which thus emits a flash light for photography.

Since this flashing is effected by the two main capacitors 4 and 5, the quantity of such flash light is greater than that of the aforesaid flash light as the transmission signal. In other words, the flash light which is the transmission signal from the transmitter of the remote control device need only be sufficient to be sensed by the receiver and may thus be slight in quantity, as compared with the flash light for photography.

A specific form of the switch 7 will now be explained by reference to FIGS. 2, 3, 4 and 5.

Figure 2:
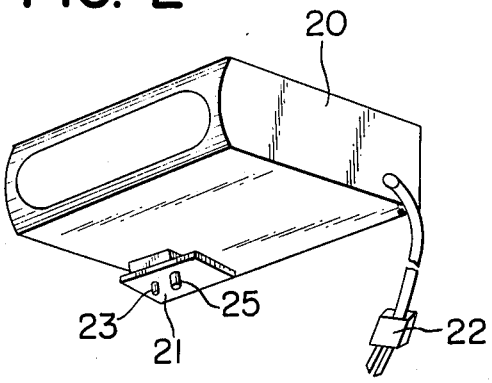
FIG. 2 is a pictorial, perspective view of the electronic flash unit according to the present invention.
Figure 3:
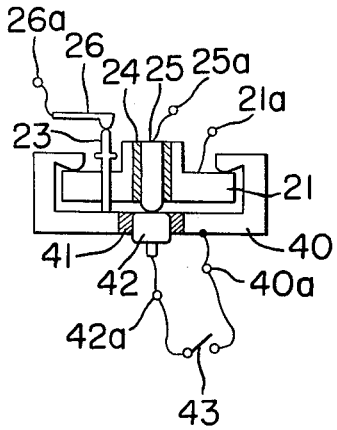
FIG. 3 is a cross-sectional view of the accessory shoe of the present invention.

Referring to FIG. 2 which shows a pictorial view of the flash unit, the flash unit body 20 has an accessory shoe 21 for connection to the accessory clip of the camera body, and a synchro plug 22. In FIG. 3 which is a cross-sectional view showing the manner of connection between the accessory shoe 21 and the camera's accessory clip, the electrically conductive shoe 21 includes an electrically conductive pin 23 slidable while keeping electrical connection with the shoe 21 and downwardly biased by an unshown spring, and a conductor 25 insulated from the shoe by an insulator 24. The shoe 21 is connected to the switch contacts 10*b* and 7*b* of FIG. 1 by a lead 21*a*, the conductor 25 is connected to the switch contact 10*a* of FIG. 1, and a conductor 26 engageable with the pin 23 is connected to the switch contact 7*a* of FIG. 1 through a lead 26*a*.

On the other hand, the conductive accessory clip 40 of the camera includes a conductor 42 insulated therefrom by an insulator 41. The clip 40 is connected to one end of the camera's synchro switch 43 through a lead 40*a*, and the conductor 42 is connected to the other end of the synchro switch through a lead 42*a*.

When the shoe 21 is coupled to the clip 40 as shown, the pin 23 is raised upwardly against the biasing force imparted thereto and brought into contact with the conductor 26. Thus, the pin 23 and the conductor 26 together constitute the switch 7. Due to the coupling of the shoe to the clip, the lead 26*a* is connected to the lead 21*a* through the conductor 26, the pin 23 and the shoe 21, so that the switch 7 is closed and the lead 25*a* is connected to the lead 42*a* through the conductors 25 and 42 while the lead 21*a* is connected to the lead 40*a* through the shoe 21 and the clip 40, whereby the synchro switch 43 is parallel-connected to the switch 10. When the shoe is uncoupled from the clip, the pin is moved downwardly by the biasing force and brought out of engagement with the conductor 26, thus opening the switch 7. By attaching the flash unit 20 to a camera with the aid of the shoe and clip in the manner described above, the synchro switch 43 is parallel-connected to the trigger switch 10 while, at the same time, the switch 7 is automatically closed. It is well known in the art to employ a manually operable switch (not shown) on the body of the flash unit for testing the operability of the flash lamp prior to exposure, and this switch may be closed to actuate the flash lamp when the flash unit is used as the transmitter.

Figure 4:
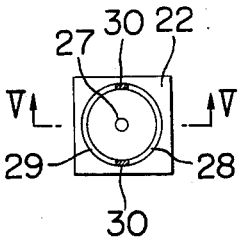
FIG. 4 is a front view of the synchro plug of the present invention.
Figure 5:
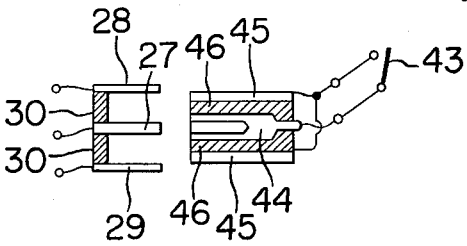
FIG. 5 is a cross-sectional view of the synchro plug of the present invention.

The synchro plug 22 will hereinafter be described by reference to FIG. 4 which is a front view of the plug and FIG. 5 which shows, in cross-section, the plug and the synchro terminals of the camera.

The synchro plug 22 is formed by a conductor 27 connected to the contact 10*a*, a conductor 28 connected to the contact 7*a*, a conductor 29 connected to the contacts 7*b* and 10*b*, and an insulator 30 insulating the three conductors from one another. On the other hand, the synchro terminal of the camera is comprised of a conductor 44 connected to one end of the synchro switch 43, a conductor 45 connected to the other end of the synchro switch 43, and an insulator 46 between the two conductors 44 and 45. Thus, insertion of the plug 22 into synchro terminals 44–46 brings the conductors 28, 29 into contact with the conductor 45 and brings the conductor 27 into contact with the conductor 44, so that the switch 7 is closed and the synchro switch 43 is parallel-connected to the trigger switch 10.

Thus, with the flash unit connected to the synchro switch 43 of the camera by the use of the plug 22 or the shoe 21, a quantity of light necessary for flash photography may be emitted.

Figure 6:
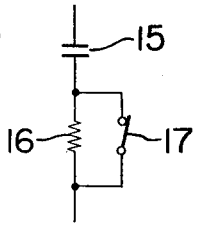
FIG. 6 is a circuit diagram of a portion of a second embodiment of the present invention.

FIG. 6 shows a second embodiment of the present invention.

In the second embodiment, the main capacitors 4 and 5, the resistor 6 and the switch 7 of FIG. 1 are replaced by series-connected main capacitor 15 and resistor 16 and a switch 17 parallel-connected to the resistor, which switch 17, like the switch of FIG. 1, is adapted to be closed for flash photography. In the other points, the second embodiment is similar in construction to the embodiment of FIG. 1.

Where the flash unit of the above-described construction is used as the transmitter, the main capacitor 15 effects discharge to the discharge tube through the resistor 16 and thus, the quantity of flash light is small, but where the flash unit is used for flash photography, the resistor 16 is short-circuited by the switch 17, thus increasing the quantity of flash light.

According to the present invention, as will be appreciated, the electronic flash unit serving both as the transmitter of a remote control device and the flash unit for common flash photography can decrease the quantity of flash light emitted therefrom when used as the transmitter but can increase the quantity of flash light when used for flash photography and moreover, it permits the change-over of the quantity of flash light to occur in response to the change-over of the mode of use, thus preventing the change-over of the quantity of flash light from being inadvertently neglected.

We claim:

1. An electronic flash unit serving both as the transmitter of a remote control device and a flash unit for flash photography, comprising; a power source, a flash discharge tube, a discharging circuit having an interlocking switch (7; 17) adapted to be closed in response to electrical connection of said flash unit to the synchro contacts of a camera body, said discharging circuit producing a greater magnitude of discharging current for the flashing of said flash discharge tube during the closing of said switch than during the opening of said switch, and a trigger circuit (8, 9, 10, 11, 12) having an extraneously operable trigger switch (10, 10*a*, 10*b*) and effective to trigger said flash discharge tube to effect the discharge of said discharging circuit, whereby the quantity of flash light emitted from said flash discharge tube when the connection of said flash unit to the synchro contacts of said camera body is broken is less than that emitted when said connection is established.

2. An electronic flash unit according to claim 1, wherein said discharging circuit includes a first main capacitor (4) charged by said power source (1) and a second main capacitor (5) parallel-connected to said first main capacitor through a series-connected resistor (6), and said interlocking switch is parallel-connected to said resistor, whereby when said flash unit is connected to the synchro contacts of said camera body, the flashing of said flash discharge tube is effected by the discharge from both of said first and said second main capacitors and when said connection is broken, the flashing of said flash discharge tube is effected by the discharge only from said first main capacitor.

3. An electronic flash unit according to claim 1, wherein said discharging circuit includes a main capacitor (15) parallel-connected to said power source (1) through a series-connected resistor (16), and said interlocking switch (17) is parallel-connected to said resistor (16), whereby when said flash unit is connected to the synchro contacts of said camera body, the flashing of said flash discharge tube is effected by the discharge from said main capacitor through said interlocking switch (17) and when said connection is broken, the flashing of said flash discharge tube is effected by the discharge from said main capacitor through said resistor.

4. An electronic flash unit according to claim 1, wherein the electrical connection of said flash unit to said camera body is established by the attachment of the accessory shoe of said flash unit to the accessory clip of said camera body.

5. An electronic flash unit according to claim 1, wherein the electrical connection of said flash unit to said camera body is established by the connection of the synchro plug of said flash unit to the synchro terminals of said camera body.

* * * * *